US005764783A

United States Patent [19]

Ferralli

[11] Patent Number: 5,764,783

[45] Date of Patent: Jun. 9, 1998

[54] VARIABLE BEAMWIDTH TRANSDUCER

[75] Inventor: Michael W. Ferralli, Fairview, Pa.

[73] Assignee: Technology Licensing Company, Pittsburgh, Pa.

[21] Appl. No.: 587,299

[22] Filed: Jan. 16, 1996

[51] Int. Cl.[6] ..... H04R 25/00

[52] U.S. Cl. ..... 381/160; 181/155

[58] Field of Search ..... 381/90, 160, 159; 181/144, 153, 155, 156

[56] References Cited

U.S. PATENT DOCUMENTS

| | | | |
|---|---|---|---|
| 1,716,199 | 6/1929 | Von Hofe et al. . | |
| 2,064,911 | 12/1936 | Hayes | 181/0.5 |
| 3,007,133 | 10/1961 | Padberg, Jr. | 340/12 |
| 3,754,618 | 8/1973 | Sasaki | 181/31 B |
| 3,819,005 | 6/1974 | Westlund | 181/31 A |
| 3,819,006 | 6/1974 | Westlund | 181/31 A |
| 3,908,095 | 9/1975 | Jinsenji | 179/102 |
| 4,190,739 | 2/1980 | Torffield | 181/30 |
| 4,225,010 | 9/1980 | Smith | 181/144 |
| 4,348,750 | 9/1982 | Schwind | 367/140 |
| 4,421,200 | 12/1983 | Ferralli et al. | 181/144 |
| 4,474,258 | 10/1984 | Westlund | 181/151 |
| 4,475,620 | 10/1984 | Carlsson | 181/146 |
| 4,588,042 | 5/1986 | Palet et al. | 181/153 |
| 4,629,030 | 12/1986 | Ferralli | 181/155 |
| 4,701,951 | 10/1987 | Kash | 181/155 |
| 4,783,824 | 11/1988 | Kobayashi | 381/195 |
| 4,836,328 | 6/1989 | Ferralli | 181/155 |
| 4,836,329 | 6/1989 | Klayman | 181/155 |
| 4,844,198 | 7/1989 | Ferralli | 181/155 |
| 4,907,671 | 3/1990 | Wiley | 181/156 |
| 5,216,209 | 6/1993 | Holdaway | 181/144 |
| 5,258,538 | 11/1993 | Queen | 181/144 |
| 5,268,539 | 12/1993 | Ono | 181/155 |
| 5,306,880 | 4/1994 | Coziar et al. | 181/149 |
| 5,371,806 | 12/1994 | Kohara et al. | 381/199 |
| 5,402,502 | 3/1995 | Boothroyd et al. | 381/160 |
| 5,418,336 | 5/1995 | Negishi et al. | 181/155 |
| 5,532,438 | 7/1996 | Brown | 181/155 |

OTHER PUBLICATIONS

Sonic Systems, Inc., Soundsphere Product Technical Information, Model No. 110 A, Fall 1994.

*Primary Examiner*—Curtis Kuntz
*Assistant Examiner*—Rexford N. Barnie
*Attorney, Agent, or Firm*—Titus & McConomy

[57] ABSTRACT

The invention comprises a device capable of emitting either acoustic or electromagnetic radiant energy. The device has at least one movable transducing element for producing this energy, and at least one reflector with a smooth concave surface which reflects the energy emitted from the transducing element. The shape of the reflector surface is preferably defined by either a rotated ellipse or a rotated parabola. A reflector surface of either shape is characterized by a continuum of distinct focal points that define a focal curve, such that each distinct focal point of the continuum is a unique focal point of each ellipse or parabola in the continuum forming the reflector surface. The radius of curvature of the parabolic surface of revolution can be extended up to an infinite length, causing the focal curve to appear as a straight line. The movable transducing element may be positioned above the reflector surface to produce energy that is redirected by the reflector surface into a focal region containing the focal curve, causing the focal region to appear as the source of the energy. The radiation pattern, or beamwidth, of this reflected energy will be substantially frequency invariant when the transducer is positioned symmetrically about the axis of revolution. However, the beamwidth can be adjusted by moving the transducer to another location. In addition, a means is provided for absorbing or attenuating that radiation which is not reflected from the reflector surface, in order to eliminate interference between reflected and non-reflected radiation.

16 Claims, 6 Drawing Sheets

Ellipse–Generated Reflector

VARIABLE BEAMWIDTH TRANSDUCER

FIELD OF THE INVENTION

This invention relates to transducers, and specifically to an improved transducer system for controlling and varying beamwidth, while utilizing a reflective component to reflect and redirect acoustic or electromagnetic radiation.

BACKGROUND OF THE INVENTION

Heretofore, acoustic and other transducers, including loudspeakers, compression drivers, light sources and sources of electromagnetic radiation such as antennas or klystron devices, have made use of a myriad of methods to convert electric signals from one form to another or, in the case of acoustic transducers to convert electric signals to acoustic signals. For example, the vast majority of acoustic transducers operate by electromagnetically coupling an electric signal to a diaphragm in order to create the acoustic signal. A primary deficiency of these acoustic transducers is their frequency dependent beamwidth. In general, the beamwidth of many state-of-the-art acoustic and electromagnetic transducers is a function of the frequency of vibration and the size of the vibrating element.

Recently a transducing system has become available (U.S. Pat. No. 4,421,200) which controls beamwidth dependence by using a reflective component shaped as a section of elliptical cross sections that have radially oriented distinct focal points and share a common focal point. Transducers placed at the distinct focal points have their acoustic or electromagnetic radiation redirected to the common focal point. By selecting the parameters of the ellipses and their orientation with respect to one another, the redirected energy, appearing to emanate from the common focal point, can be made to have a nearly constant beamwidth, irrespective of the frequency dependent beamwidth of the transducers placed at the distinct focal points. The beamwidth of the redirected energy in this novel transducing system is fixed by the parameters of the ellipses shaping the reflective component, and thus is not variable. Moreover, it may not be possible to reflect all the radiation emitted from the transducers, resulting in interference between the reflected and non-reflected radiation.

Another new transducing system (U.S. Pat. No. 4,629,030) utilizes a reflective component with a surface defined by an ellipse that is rotated about an axis of revolution which lies in the plane of the ellipse, and which is oriented at any finite angle with respect to the major axis of the ellipse. This axis of revolution contains the focal points that are common to the ellipse as it is rotated. This reflective component is characterized by a common focal point as well as a focal curve. By placing a transducer at the common focal point, electromagnetic or acoustic radiation is redirected by the reflective component and focused on the focal curve, causing the focal curve to appear as the source of the radiation. Conversely, electromagnetic or acoustic radiation emitted from a transducer placed at the focal curve will be focused on the common focal point. In that case, the common focal point appears to be the source of the radiation. This transducing system also has a fixed beamwidth determined by the parameters of the ellipse shaping the reflective component. It is also possible for the redirected energy to be degraded by interference with electromagnetic or acoustic radiation which emanates from the transducer but does not strike the reflective component.

Yet another new transducing system (U.S. Pat. No. 4,836,328) utilizes a reflective component with a surface defined by a parabola that is rotated about an axis of revolution that lies in the plane of the parabola and is oriented parallel to the major axis of the parabola. The reflective component is characterized by a focal curve. Electromagnetic or acoustic radiation emanating from a transducer placed perpendicular to both axes will be redirected by the reflective component and focused on the focal curve, causing the focal curve to appear as the source of the radiation. Conversely, electromagnetic or acoustic radiation from a transducer placed at the focal curve will be redirected as if emanating from a plane wave. This transducing system is also has a fixed beamwidth determined by the parameters of the parabola shaping the reflective component, and it is possible that the redirected energy may be degraded by interference with electromagnetic or acoustic radiation which emanates from the transducer but does not strike the reflective component.

Finally, new sound output devices (U.S. Pat. Nos. 5,306,880 and 5,418,336) provide a design for directionalizing acoustic radiation through use of a conical reflecting surface having a central axis offset from the center of the transducer. This particular design is also deficient in that the beamwidth is not variable, since it is set by the fixed location of the transducer.

These prior art inventions do not provide a means for varying the beamwidth of the redirected acoustic or electromagnetic energy. Moreover, these prior art systems do not provide a means to eliminate the electromagnetic or acoustic radiation which emanates from the transducer but does not strike the reflective component.

Accordingly it is an object of the present invention to provide a means of varying the beamwidth of acoustic or electromagnetic radiation emanating from a transducing system utilizing a concave reflective component, without altering the parameters of the reflective component.

Another object of the present invention to provide an acoustic or electromagnetic absorbing element which will attenuate or eliminate that radiation which would not otherwise strike the reflective component.

Another object of this invention is to provide a combined means of varying the beamwidth of acoustic or electromagnetic radiation emanating from a transducing system utilizing a concave reflective component, without altering the parameters of the reflective component, in combination with an acoustic or electromagnetic absorbing element which will attenuate or eliminate that radiation which would not otherwise strike or impinge upon the reflective component.

Another object of this invention is to provide an acoustic or electromagnetic transducing system with the attributes described above, with a parabolic reflective component having an apparently infinite radius of curvature.

SUMMARY OF THE INVENTION

The invention comprises a device capable of emitting either acoustic or electromagnetic radiant energy. The device has at least one movable transducing element for producing this energy, and at least one reflector with a smooth concave surface which reflects the energy emitted from the transducing element. The shape of the reflector surface is preferably defined by either a rotated ellipse or a rotated parabola. The reflector surface is defined by rotating, from zero up to one complete revolution, a section of the desired geometric shape about an axis of revolution that lies in the plane of the geometric shape.

In the case of the ellipse, the axis of revolution lies in the plane of the ellipse, is oriented at any angle greater than zero with respect to the major axis of the ellipse, and intersects the major axis of the ellipse at the focal point that is common to the continuum of ellipses defined by the rotation. In the case of the parabola, the axis of revolution lies in the plane of the parabola, and is parallel to the major axis of the parabola. A reflector surface of either shape is characterized by a continuum of distinct focal points that define a focal curve, such that each distinct focal point of the continuum is a unique focal point of each ellipse or parabola in the continuum forming the reflector surface the radius of curvature of the parabolic surface of revolution can be extended up to an infinite length, causing the focal curve to appear as a straight line.

The movable transducing element may be positioned above the reflector surface to produce energy that is redirected by the reflector surface into a focal region containing the focal curve, causing the focal region to appear as the source of the energy. The radiation pattern, or beamwidth, of this reflected energy will be substantially frequency invariant when the transducer is positioned symmetrically about the axis of revolution. However, the beamwidth can be adjusted by moving the transducer to another location. In addition, a means is provided for absorbing or attenuating that radiation which is not reflected from the reflector surface, in order to eliminate interference between reflected and non-reflected radiation.

BRIEF DESCRIPTION OF DRAWINGS

FIG. (1) is an orthogonal view of an ellipse rotated to define an elliptical surface of revolution.

FIG. (2) is an orthogonal view of a parabola rotated to define a parabolic surface of revolution.

Figure 1:
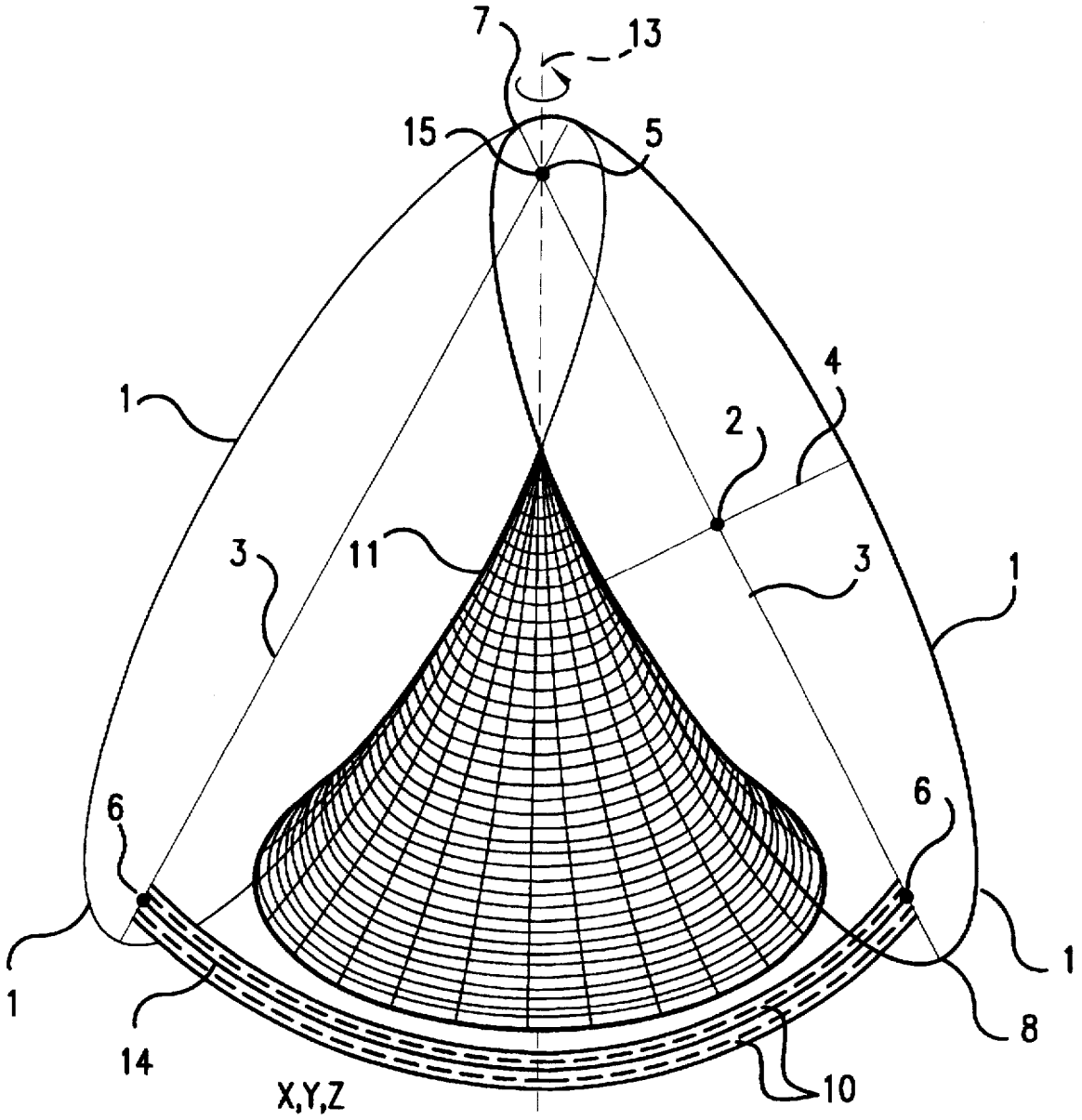
Figure 2:
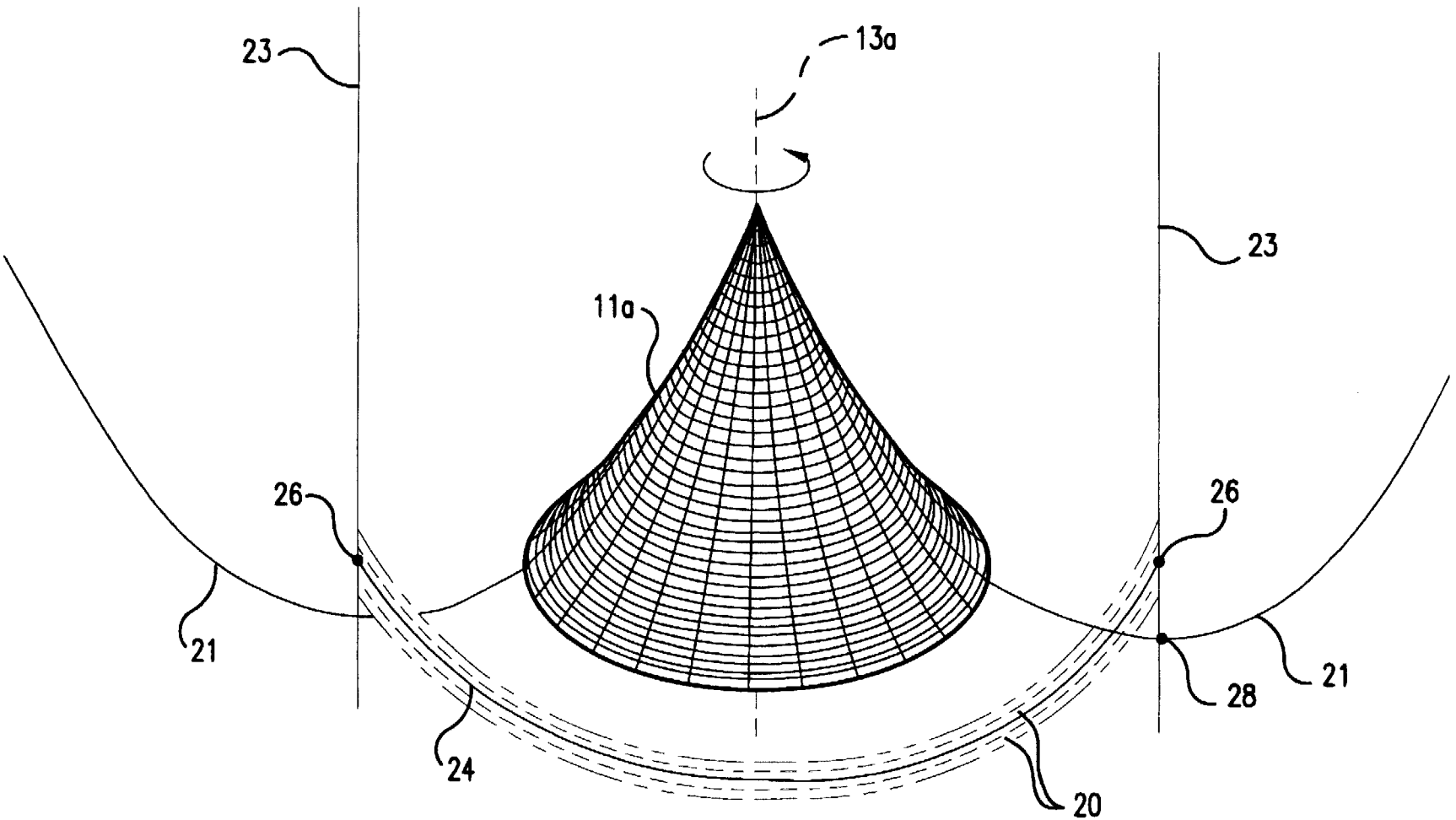
Figure 3:
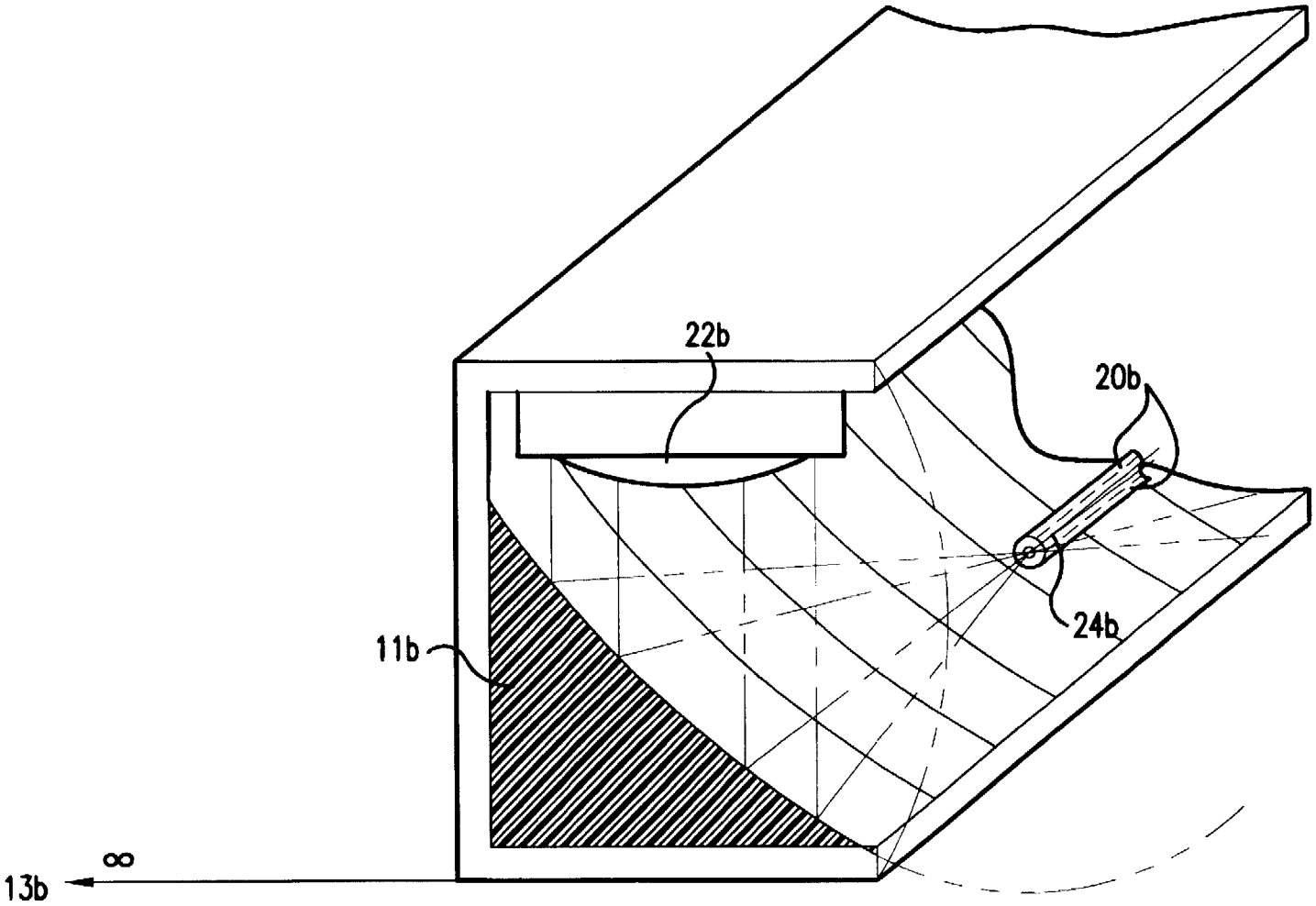
Figure 4:
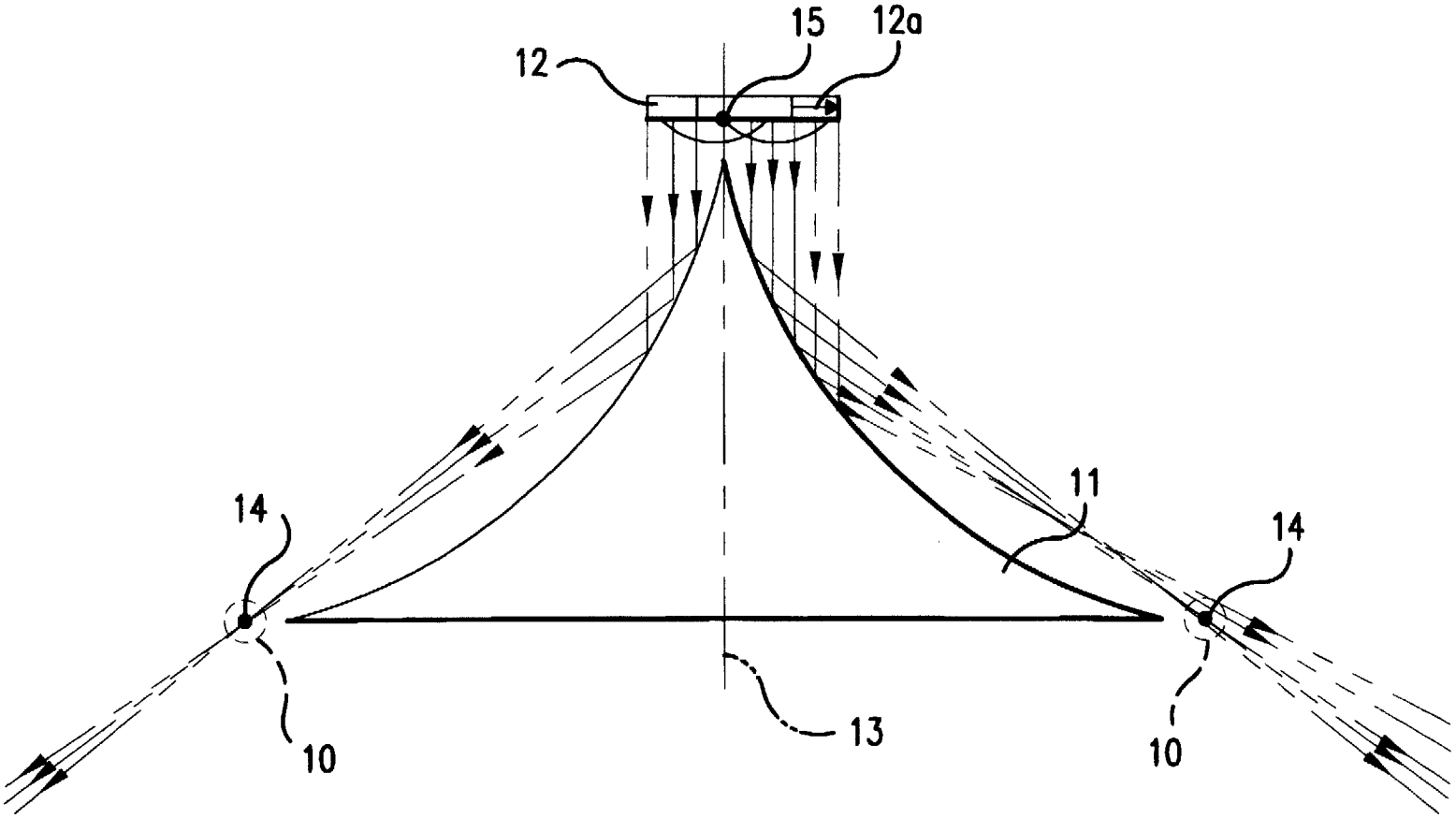
Figure 5:
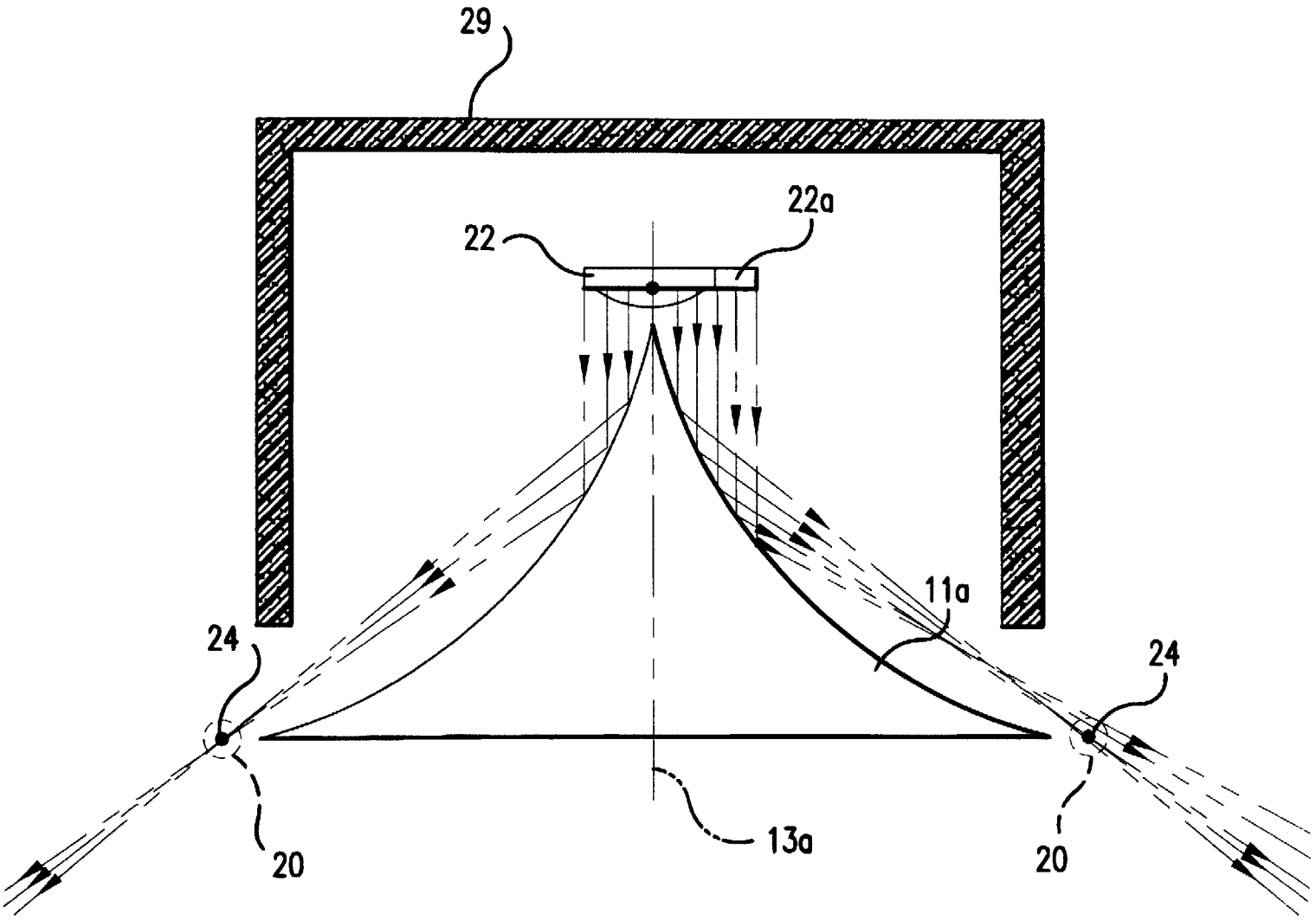
Figure 6:
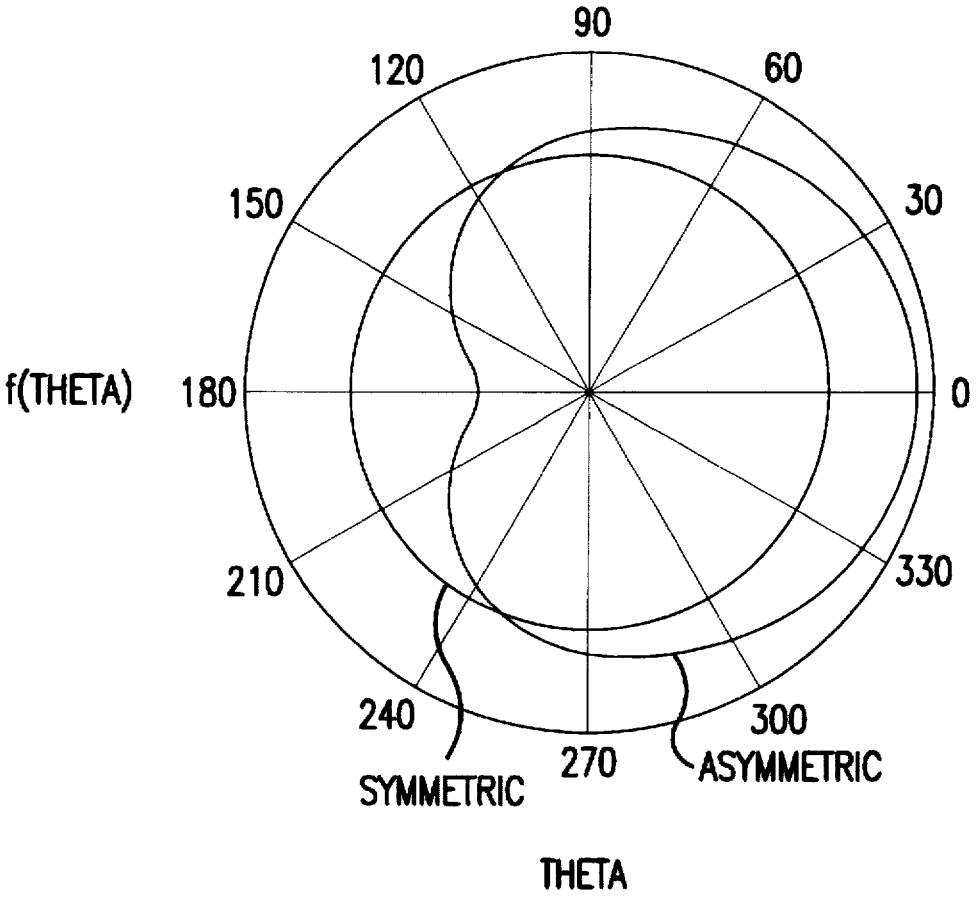

FIG. (3) is an orthogonal view of a parabolic surface of revolution with an infinite radius of curvature.

FIG. (4) is a sectional elevation view one embodiment of the invention, utilizing a reflector and a movable transducing element.

FIG. (5) is a sectional elevation view of another embodiment of the invention, utilizing a reflector, a movable transducing element, and a radiation attenuation means.

FIG. (6) is a polar plot of the radiation intensity around the axis of rotational symmetry of the reflector, illustrating the change in the beamwidth of the transducer system as the transducer is moved from the axis of rotational symmetry in a plane perpendicular to this axis.

DETAILED DESCRIPTION OF THE PREFERRED EMBODIMENTS

As used herein, the reflector surface is an acoustic or electromagnetic reflective shell with a smooth concave surface made of acoustically reflective materials known in the art, such as wood, metal, concrete, or plastic, or with a surface made of materials known to be capable of reflecting electromagnetic energy, such as metal, an electrically conducting metal-fiberglass composite, dielectrics, or such as mirrors in the case of visible light.

Referring to FIG. (1), the surface of this reflector 11 can preferably be defined by revolving an ellipse 1 about an axis of revolution 13. The ellipse 1 includes two axes 3 and 4 that are perpendicular to one another and that intersect at the center 2 of the ellipse. The major axis 3 is the longer of the two axes, and it contains the two focal points 5 and 6 of the ellipse. The focal points 5 and 6 are located along the major axis 3 at points equidistant from the two vertices 7 and 8, which are both bisected by the major axis 3. The curvature of the surface of the ellipse 1 is such that any wavefront originating at focal point 5 or 6 that is reflected from the elliptical surface will pass through the opposite focal point 6 or 5.

To define the reflector surface 11, the ellipse 1 is rotated about an axis of revolution 13 that lies in the plane of the ellipse 1. The axis of revolution 13 can be oriented at any angle greater than zero with respect to the ellipse major axis 3, and it intersects the ellipse major axis 3 at a point 15 that substantially coincides with the focal point 5 that remains common to the continuum of ellipses generated by rotation of the ellipse 1. As a section of the ellipse 1 is rotated about the axis of revolution 13 for any angular distance between zero and one complete revolution, it defines the shape of the reflector surface 11. This reflector surface 11 is characterized by a common focal point 15 lying above the reflector surface 11, and a set of distinct focal points defining a focal curve 14. Each distinct focal point in the focal curve 14 is the unique focal point 6 of each single ellipse in the continuum of ellipses forming the reflector surface 11.

Ideally as shown in FIG. (4), energy produced by a transducing element 12 symmetrically positioned about axis of revolution 13 will be reflected entirely on the focal curve 14. In the case of the elliptical surface, the energy will be focused entirely onto the focal curve 14 if the transducing element 12 is positioned such that the "virtual source" of its produced energy coincides with the common focal point 15. The "virtual source" is characterized as that point from which all the energy produced by the transducing element 12 would emanate, if the transducing element 12 were replaced by a single point. As also shown in FIG. (4), an elliptical transducing element **12*a*, not symmetrically positioned about the axis of revolution 13, will produce energy that is substantially reflected into a focal region 10 containing the focal curve 14. The focused energy will be redirected as if emanating from the focal region 10, causing the focal region 10** to appear as the source of the energy.

The focal region is an area having an increased concentration of acoustic or electromagnetic radiant energy. The energy level concentration within the focal region 10 will vary relative to the positioning of the transducing element with respect to the reflector axis of revolution. This invention takes advantage of this characteristic focal region by using the positioning of the transducing element relative to the reflector axis of revolution to control and vary the beamwidth shape of the redirected energy that is reflected through the focal region. It is well known in the state of the art that transducing systems utilizing a reflective component will function properly despite a lack of perfect precision in the positioning of the transducing element relative to the reflective surface. This lack of precision may be created by machining tolerances in the reflective surface, or by an inexact mounting of the transducing element relative to the reflective component.

As shown in FIG. (4), when a lack of perfect precision prevents the transducing element **12*a* from being positioned in an exactly symmetric manner about the reflector axis of revolution 13, its energy will not be focused entirely on the focal curve 14, but will be substantially focused into a focal region 10 surrounding the focal curve 14. The principal limitation placed on the positioning of the transducing element 12 with respect to the reflector axis of revolution 13 in the elliptical design is that the energy produced by the transducing element 12 that strikes the reflector surface 11 must be substantially focused into the focal region 10. In the elliptical embodiment, the redirected energy will be substantially focused into the focal region 10 if the transducing element 12*a* is positioned such that the "virtual source" of the produced energy is approximately, but not perfectly, coincident with the common focal point 15**.

This invention also preferably contemplates a reflector surface 11*a* defined by a revolved parabola 21. The parabola 21, shown in FIG. (2), is a curved geometric figure defined by a major axis 23 that bisects a single vertex 28. The parabola 21 is further defined by a single focal point 26, which is located along the parabola major axis 23 such that any wavefront reflected from the surface of the parabola 21 will pass through the focal point 26. To form the reflector surface 11*a*, the parabola 21 is rotated about an axis of revolution 13*a* that lies in the plane of the parabola 21, and is oriented substantially parallel to the parabola major axis 23. As a section of the parabola 21 is rotated about the axis of revolution 13*a* for any angular distance between zero and one complete revolution, it defines the shape of the reflector surface 11*a*. This reflector surface 11*a* is characterized by a set of distinct focal points defining a focal curve 24. Each distinct focal point in the focal curve 24 is the unique focal point 26 of each single parabola in the continuum of parabolas forming the reflector surface 11*a*.

Referring to FIG. (5), radiant energy produced by a parabolic transducing element 22 positioned symmetrically about the axis of revolution 13*a*, that travels a path substantially parallel to the axis of revolution 13*a*, will be reflected by the reflector surface 11*a* entirely on the focal curve 24. Radiant energy produced by a parabolic transducing element 22*a* positioned anywhere above the reflector surface 11*a*, that travels a path substantially parallel to the axis of revolution 13*a*, will be substantially focused by the reflector surface 11*a* into a focal region 20 surrounding the focal curve 24. The focused energy will be redirected as if emanating from the focal region 20, causing the focal region 20 to appear as the source of the energy.

Finally referring to FIG. (3), the invention may also embodied by a parabolically shaped reflector surface 11*b* having an apparently infinite radius of curvature about the axis of revolution 13*b*. This apparently infinite radius of curvature will cause the focal curve 24*b* to appear as a straight line for the portion of the reflector surface 11*b* that receives radiation from the transducing element 22*b*. Radiant energy produced by a transducing element 22*b* positioned anywhere above the reflector surface 11*b*, that travels a path substantially parallel to the axis of revolution 13*b*, will be substantially focused by the reflector surface 11*b* into a focal region 20*b* surrounding the focal curve 24*b*. This portion of the focal region 20*b* will appear cylindrical in shape due to the apparently infinite radius of curvature of the reflector surface 11*b*. The focused energy will be redirected as if emanating from the cylindrical focal region 20*b*, causing the cylindrical focal region 20*b* to appear as the source of the energy.

The transducer described herein may act as an acoustic transducer, which acts to convert an electrical signal to an acoustical signal by any methods known in the state of the art such as a loudspeaker, or as an electromagnetic transducer, which acts to convert an electric signal to an electromagnetic signal by any methods known in the state of the art such as an antenna or light source. Other transducing means in the state of the art that will convert electrical current into acoustic energy (such as plasma or glow discharge loudspeaker), or that will convert electrical current into electromagnetic radiation (such as a laser, light-emitting diode, glow discharge tube or a lightbulb) will work with the concepts disclosed and are thus covered the use of the term transducer herein.

The embodiment of the invention showing a means of moving and fixing a transducer at various positions relative to the axis of revolution 13 is shown in FIG. (4). The transducing element 12 is initially ideally positioned symmetrically about the axis of revolution 13 of the reflector surface 11. Acoustic or electromagnetic radiation emitted from the transducing element 12 is directed substantially toward the reflector surface 11, is reflected therefrom, and is focused entirely on the focal curve 14. The transducing element 12*a* may be moved to another location asymmetric with the axis of revolution 13. This movement can be accomplished by any means in the state of the art, including mechanically actuated means such as screws or sliding pins, or electrically actuated means such as a servomotor or a piezoelectric motor. The transducing element 12*a* may be fixed at the new location by any means in the state of the art, including mechanically actuated means such as screw locks, or frictional clamps, or electrically actuated means such as a servomotor or a solenoid. In its initial position symmetric about the axis of revolution 13, radiation emitted from the transducing element 12 is initially redirected uniformly from the reflector surface 11, with approximately equal intensity and an approximately 360 degree radiation pattern (beamwidth) from any point on the focal curve 14. As the transducing element 12*a* is moved to a position asymmetric with respect to the axis of revolution 13, the emitted acoustic or electromagnetic radiation will be redirected non-uniformly from the reflector surface 11, with variable intensity and beanwidth from the points within the focal region 10 surrounding and containing the focal curve 14. The means of moving and fixing transducing elements described above can be used with all surfaces and with all transducing elements described.

FIG. (6) illustrates the change in intensity of the emitted acoustic or electromagnetic radiation, as an acoustic transducing element is moved as described above. As can be seen, the intensity varies such that the beamwidth of the acoustic signal is narrowed as the transducing element is moved as described above. It is important to note that the beamwidth is controlled by the relative position of the transducing element in relation to the axis of revolution of the reflector surface. The beamwidth of the radiation has been rendered substantially independent of frequency changes by the attributes of the reflector surface 11 as shown in the state of the art, and thus for any fixed location of the transducing element above the reflector surface, the beamwidth will remain constant as the frequency of the radiation is varied.

The embodiment of a means of moving and fixing the transducer at various positions relative to the axis of revolution, combined with a means of attenuating or eliminating that radiation which would not strike the reflective component, is shown in FIG. (5). In the operation of this embodiment, the transducing element 22 is initially ideally positioned symmetrically about the axis of revolution 13*a*. Acoustic or electromagnetic radiation emitted from the transducing element 22 is directed substantially toward the reflector surface 11*a*, is reflected therefrom, and is focused on the appropriate focal curve 24. Acoustic or electromagnetic radiation which would not strike and be reflected from reflector surface 11*a* is absorbed by absorbing element 29. Depending on the nature of the transducing system utilized, the absorbing element 29 may be constructed of a material capable of absorbing or attenuating acoustic energy, such as fiberglass or foam, or of a material capable of absorbing or attenuating electromagnetic radiation, such as carbon-plastic or metallic-plastic composites, or flat black paint in the case of visible light. As is obvious but not shown, the absorbing element 29 may be extended in a direction parallel to the axis of revolution 13*a*, toward or away from reflector surface 11*a*, so as to vary the amount acoustic or electromagnetic radiation absorbed or attenuated.

While presently preferred embodiments have been shown and described in particularity, the invention may be otherwise embodied within the scope of the appended claims.

What is claimed is:

1. An apparatus for transducing acoustic or electromagnetic radiant energy, which comprises:

A. at least one reflector having a smooth concave surface defining at least a portion of a conic section of revolution for reflecting energy into at least one focal region of said surface;

B. at least one transducing element for producing said energy being movable with respect to said reflector in a plane substantially perpendicular to the axis of said conic section; and C. a means for moving said transducing element to any location relative to said reflector such that said energy is substantially focused into said focal region and such that said reflected energy will vary in intensity and beamwidth as said transducing element is moved.

2. The apparatus of claim 1, wherein said conic section is selected from one which forms a parabolic or an elliptical surface wherein:

A. said elliptical surface is defined by rotating about a first axis at least a section of an ellipse having a major axis, said first axis lying in a plane of said ellipse and passing through a first focal point of said ellipse, said first focal point being substantially coincident with a point defined by the intersection of said first axis and said major axis, said first axis being at an angle greater than zero to said major axis, said reflector reflecting said energy into said focal region having an energy intensity about a focal arc defined by the rotation of a second focal point of said ellipse about said first axis; and B. said parabolic surface is defined by rotating about a first axis at least a section of a parabola having a major axis, said first axis lying in a plane of said parabola and being substantially parallel said major axis, said reflector reflecting said energy into said focal region having an energy intensity about a focal arc defined by the rotation of the focal point of said parabola about said first axis; and C. said transducing element being positioned above said reflector surface to substantially focus said energy into said focal region.

3. The apparatus of claim 2, wherein said section of said parabola has up to an infinite radius of revolution about said first axis.

4. The apparatus of claim 3, further comprising a means for fixing said transducing element at any location relative to said reflector such that said energy is substantially focused into said focal region.

5. The apparatus of claim 1, 2 or 3, further comprising an element capable of absorbing said energy which surrounds said transducing element to absorb said energy which is not incident upon said reflector.

6. The apparatus of claim 5, wherein said absorbing element is movable such that the amount of said energy absorbed varies with the position of said absorbing element.

7. The apparatus of claim 1, 2 or 3, wherein said transducing element is positioned symmetrically with respect to said reflector.

8. The apparatus of claim 1, 2 or 3, wherein said transducing element is positioned asymmetrically with respect to said reflector.

9. The apparatus of claim 1, 2 or 3, further comprising two reflectors which are positioned as mirror images of each other.

10. The apparatus of claim 9, further comprising two transducing elements which are positioned as mirror images of each other.

11. The apparatus of claims 1, 2 or 3, further comprising one reflector.

12. The apparatus of claim 11, further comprising one transducing element.

13. The apparatus of claim 1, 2 or 3, wherein acoustic sound waves are transduced.

14. The apparatus of claim 1, 2 or 3, wherein electromagnetic radiation is transduced.

15. The apparatus of claim 14, wherein microwave radiation is transduced.

16. The apparatus of claim 2, wherein at least one of the group consisting of:

A. said angle;

B. said major axis;

C. the minor axis of said ellipse; and

D. the focal length of said parabola;

is varied over the surface of said reflector.

* * * * *